US007368683B2

(12) United States Patent
Kim et al.

(10) Patent No.: US 7,368,683 B2
(45) Date of Patent: May 6, 2008

(54) CONVECTION CHAMBER OF COOKING DEVICE

(75) Inventors: Wan Soo Kim, Kwangmyung-si (KR); Yang Kyeong Kim, Buchun-si (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 11/373,107

(22) Filed: Mar. 13, 2006

(65) Prior Publication Data

US 2006/0225727 A1 Oct. 12, 2006

(30) Foreign Application Priority Data

Apr. 11, 2005 (KR) ..... 10-2005-0029995

(51) Int. Cl.
*A21B 1/00* (2006.01)
*F24C 15/32* (2006.01)

(52) U.S. Cl. ..... 219/400; 219/401; 219/388; 219/413; 126/20; 126/21 A; 126/22; 99/474; 99/475; 99/476

(58) Field of Classification Search ..... 219/400, 219/401, 388, 413; 126/20, 21 A, 22; 99/474–76
See application file for complete search history.

(56) References Cited

U.S. PATENT DOCUMENTS

| | | | |
|---|---|---|---|
| 3,719,180 | A | 3/1973 | Pere |
| 6,864,468 | B2 | 3/2005 | Kim et al. |
| 2004/0200823 | A1 | 10/2004 | Paller et al. |

FOREIGN PATENT DOCUMENTS

| | | |
|---|---|---|
| GB | 2078365 | 1/1982 |

*Primary Examiner*—Shawntina Fuqua
(74) *Attorney, Agent, or Firm*—Greenblum & Bernstein, P.L.C.

(57) ABSTRACT

A convection chamber of a cooking device includes a convection fan rotatably installed in a cooking chamber, a convection motor that rotates the convection fan, a convection cover provided in front of the convection fan and having a channel that collects air in the cooking chamber, sucks the air to the convection fan, and discharges the air from the convection fan to the cooking chamber, and a radiating fan provided between the convection fan and the convection motor and rotated by the convection motor.

19 Claims, 6 Drawing Sheets

CONVECTION CHAMBER OF COOKING DEVICE

BACKGROUND OF THE INVENTION

1. Field of the Invention

The present invention relates to a cooking device, such as an oven, and more particularly to a convection chamber of a cooking device, which uniformly disperses heat of a cooking chamber.

2. Description of the Related Art

FIG. 1 is a partially exploded perspective view of a general cooking device, FIG. 2 is a perspective view of a conventional convection chamber of a cooking device, and FIG. 3 is a longitudinal sectional view of the conventional convection chamber.

The cooking device, as shown in FIGS. 1 to 3, comprises a cabinet 2 defining the external appearance of the cooking device, a cooking chamber 4 provided in the cabinet 2 for heating food so that the food can be cooked, a door 5 installed on the cabinet 2 for opening and closing the cooking chamber 4, and an electric component chamber 6 located in the upper portion of the cooking chamber 4 in the cabinet 2 and provided with electric components installed therein.

The cooking chamber 4 is heated by an electric heater 4*a* or a burner.

The electric heater 4*a* is installed on the internal upper, lower and rear surfaces of the cooking chamber 4.

The electric component chamber 6 is configured such that electric components installed in electric component chamber 6 can be cooled by a blower 7.

A convection chamber 10 for uniformly dispersing heat into the electric component chamber 6 is installed in the electric component chamber 6.

The convection chamber 10 comprises a convection fan 12 rotatably installed on the internal rear surface of the cooking chamber 4, a convection motor 14 installed on the external rear surface of the cooking chamber 4 and connected to the convection fan 12, and a convection cover 16 provided in front of the convection fan 12 for allowing air in the cooking chamber 4 to be sucked into the center of the convection fan 12 and to be discharged in the centrifugal direction.

The convection fan 12 is located in the electric heater 4*a* installed on the internal rear surface of the cooking chamber 4.

The convection cover 16 has suction vents 16*a* formed through the central portion thereof corresponding to the center of the convection fan 12 for allowing the air in the cooking chamber 4 to be sucked into the convection fan 12, and discharge vents 16*b* formed through the edge portion thereof for allowing the air to be discharged from the convection fan 12 to the cooking chamber 14.

Hereinafter, the operation of the above conventional convection chamber 10 of the cooking device will be described.

When the cooking device is operated, the electric heater 4*a* is driven and increases the temperature of the cooking chamber 4. Further, the convection motor 14 is driven and rotates the convection fan 12, and the air in the cooking chamber 4 is dispersed by the blowing force of the convection fan 12.

In the conventional convection chamber 10 of the cooking device, the air in the cooking chamber 4 is concentrated on the suction vents 16*a* of the convection cover 16 by the blowing force of the convection fan 12. Since the suction vents 16*a* are located at the central portion of the convection cover 16, the temperature in the cooking chamber 4 is not uniform.

Particularly, when several layers of trays 4' are installed in the cooking chamber 4, the difference of temperatures in the cooking chamber 4 is increased.

SUMMARY OF THE INVENTION

Therefore, the present invention has been made in view of the above problems, and it is an object of the present invention to provide a convection chamber of a cooking device, which ensures a uniform temperature of a cooking chamber.

In accordance with one aspect of the present invention, the above and other objects can be accomplished by the provision of a convection chamber of a cooking device, comprising: a convection fan rotatably installed in a cooking chamber; a convection motor for rotating the convection fan; and a convection cover provided in front of the convection fan and having a channel for collecting air in the cooking chamber, sucking the air to the convection fan, and discharging the air from the convection fan to the cooking chamber.

The convection cover may comprise a first cover provided with suction holes for sucking the air in the cooking chamber; and a second cover forming a space with the first cover, and provided with a suction hole for sucking the air to the center of the convection fan and discharge holes for discharging the air from the convection fan to the cooking chamber.

An electric heater for increasing the temperature of the air in the cooking chamber may be located around the convection fan.

The convection fan may be a centrifugal fan which sucks air in the centripetal direction and discharges the air in the centrifugal direction.

A plurality of the suction holes may be formed through the first cover; and the suction hole may be located at the central portion of the second cover, and the discharge holes may be located at the edge portion of the second cover.

Some of the suction holes may be located at the central portion of the first cover.

The first and second covers may be integrally formed.

The first cover may be detachably attached to the second cover.

In accordance with another aspect of the present invention, there is provided a convection chamber of a cooking device, comprising: a convection fan rotatably installed in a cooking chamber for sucking air in the centripetal direction and discharging the air in the centrifugal direction; a convection motor for rotating the convection fan; and a convection cover provided in front of the convection fan and having a channel for collecting air in the cooking chamber, sucking the air to the convection fan, and discharging the air from the convection fan to the cooking chamber, wherein the convection cover comprises a first cover provided with a plurality of suction holes for sucking the air in the cooking chamber, and a second cover forming a space with the first cover and provided with a suction hole located at the central portion thereof for sucking the air to the center of the convection fan and discharge holes located at the edge portion thereof for discharging the air from the convection fan to the cooking chamber.

Some of the suction holes may be located at the central portion of the first cover.

The convection chamber of the present invention, which comprises the convection fan rotatably installed in the cooking chamber, the convection motor for rotating the convection fan, and the convection cover provided in front of the convection fan and having the channel for collecting air in the cooking chamber, sucking the air to the convection fan, and discharging air from the convection fan to the cooking chamber, allows the air in the cooking chamber to be uniformly sucked to the convection fan so that the air in the cooking chamber can be uniformly heated.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the annexed drawings.

Figure 1:
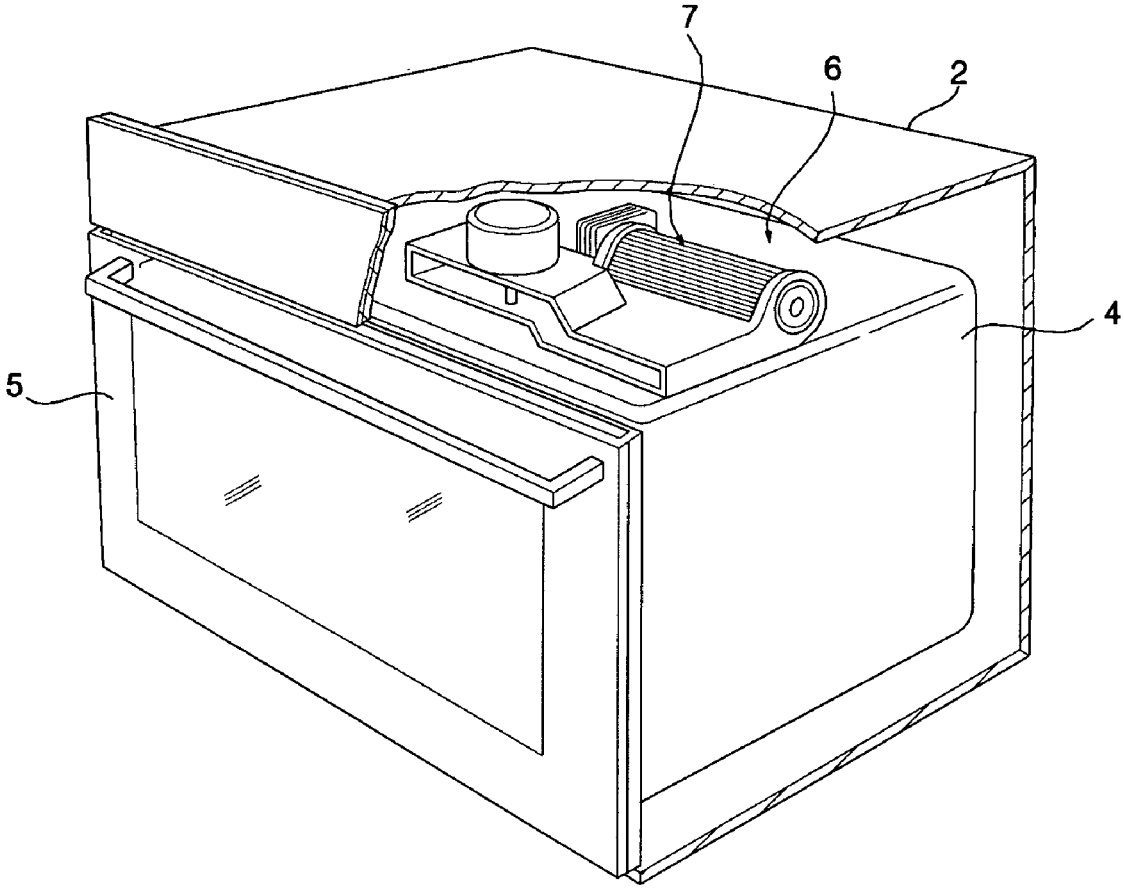
Fig. 1(related art)
FIG. 1 is a partially exploded perspective view of a general cooking device.
Figure 2:
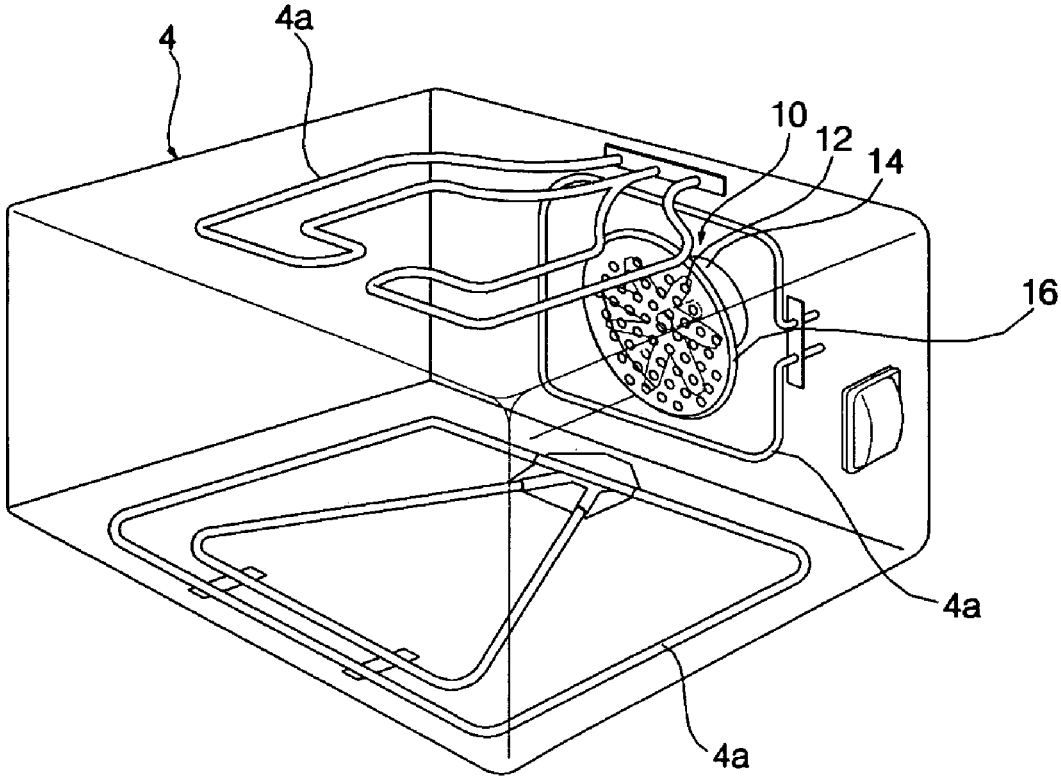
Fig. 2(related art)
FIG. 2 is a perspective view of a conventional convection chamber of a cooking device.
Figure 3:
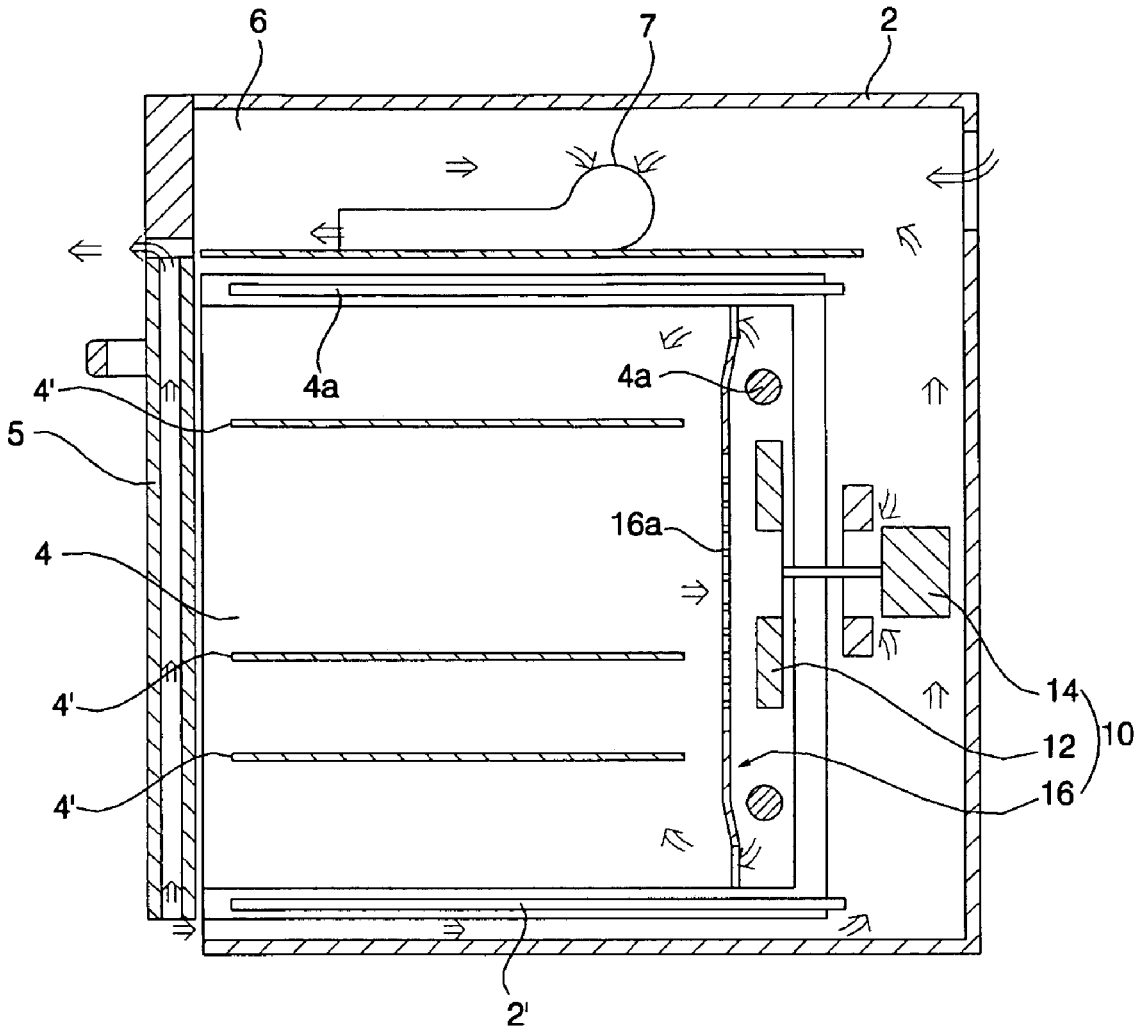
Fig. 3(related art)
FIG. 3 is a longitudinal sectional view of the conventional convection chamber.
Figure 4:
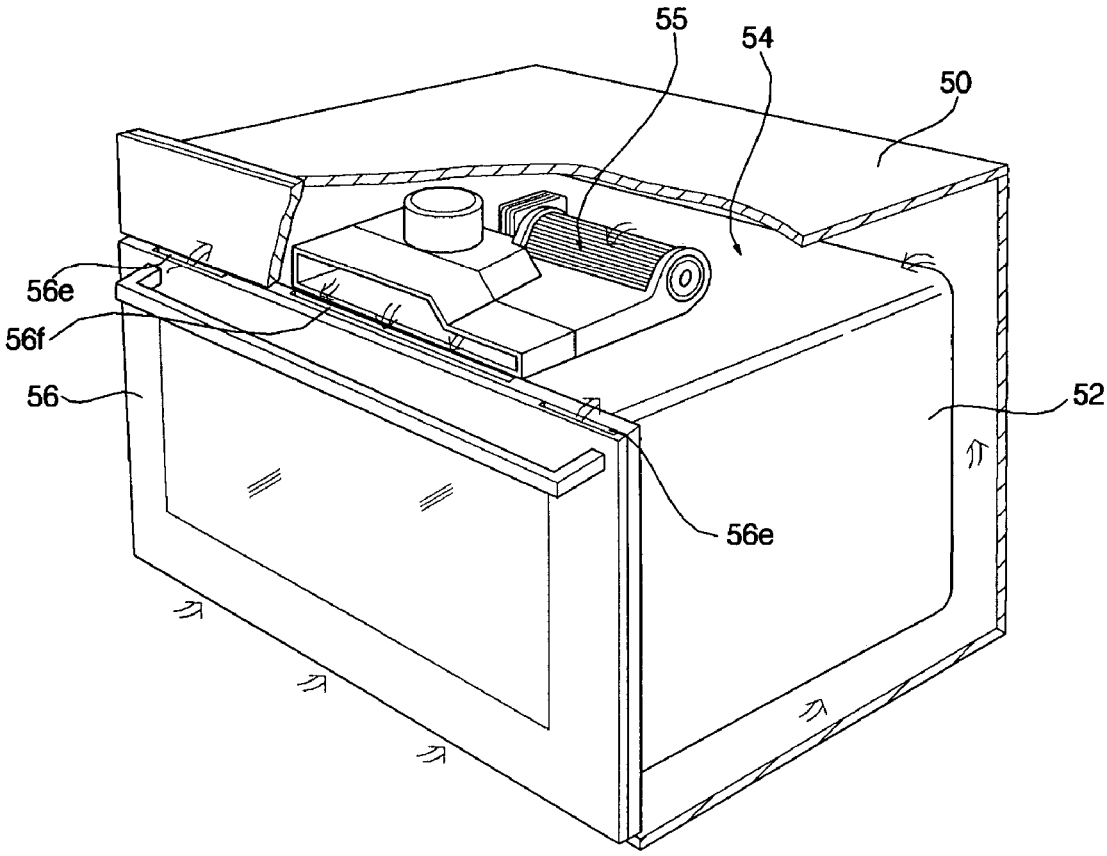
FIG. 4 is a partially exploded perspective view of a cooking device in accordance with the present invention.
Figure 5:
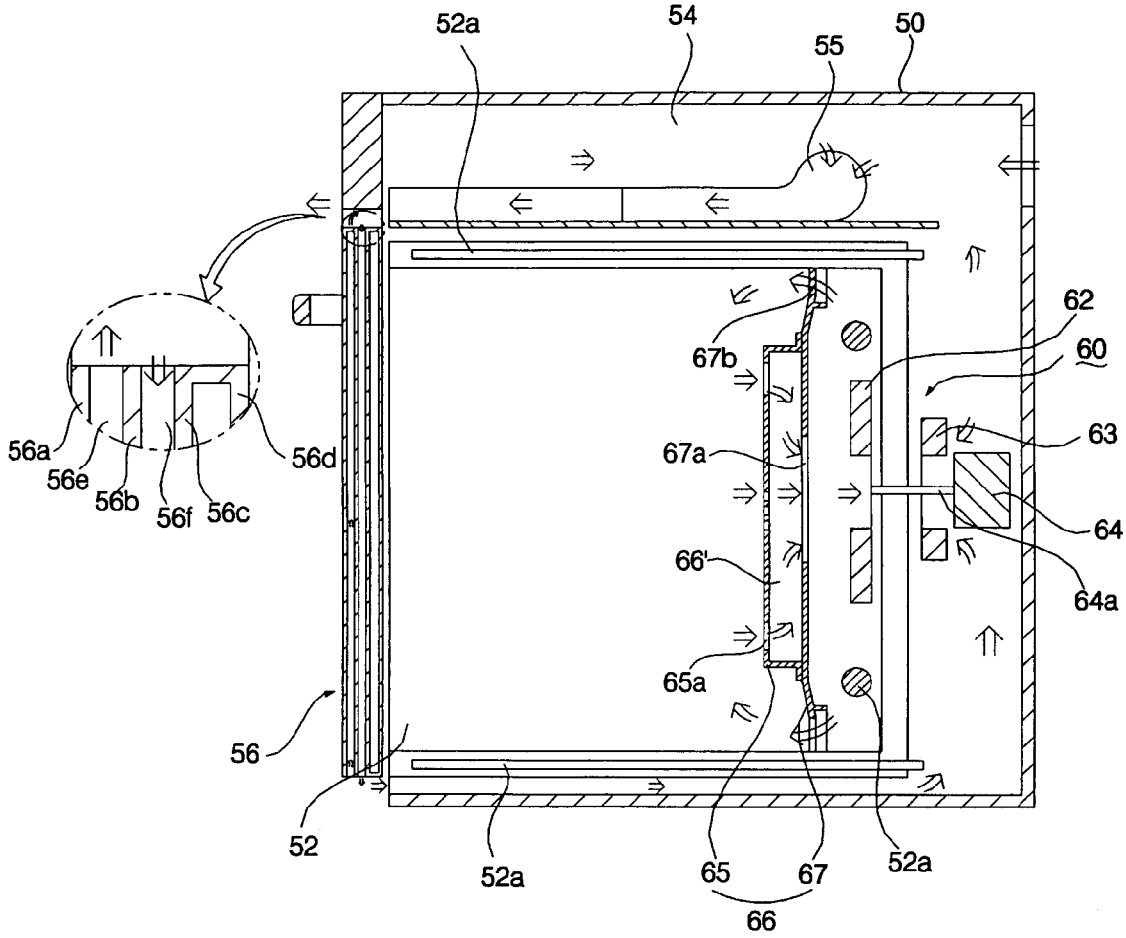
FIG. 5 is a longitudinal sectional view of a convection chamber of the cooking device in accordance with the present invention.
Figure 6:
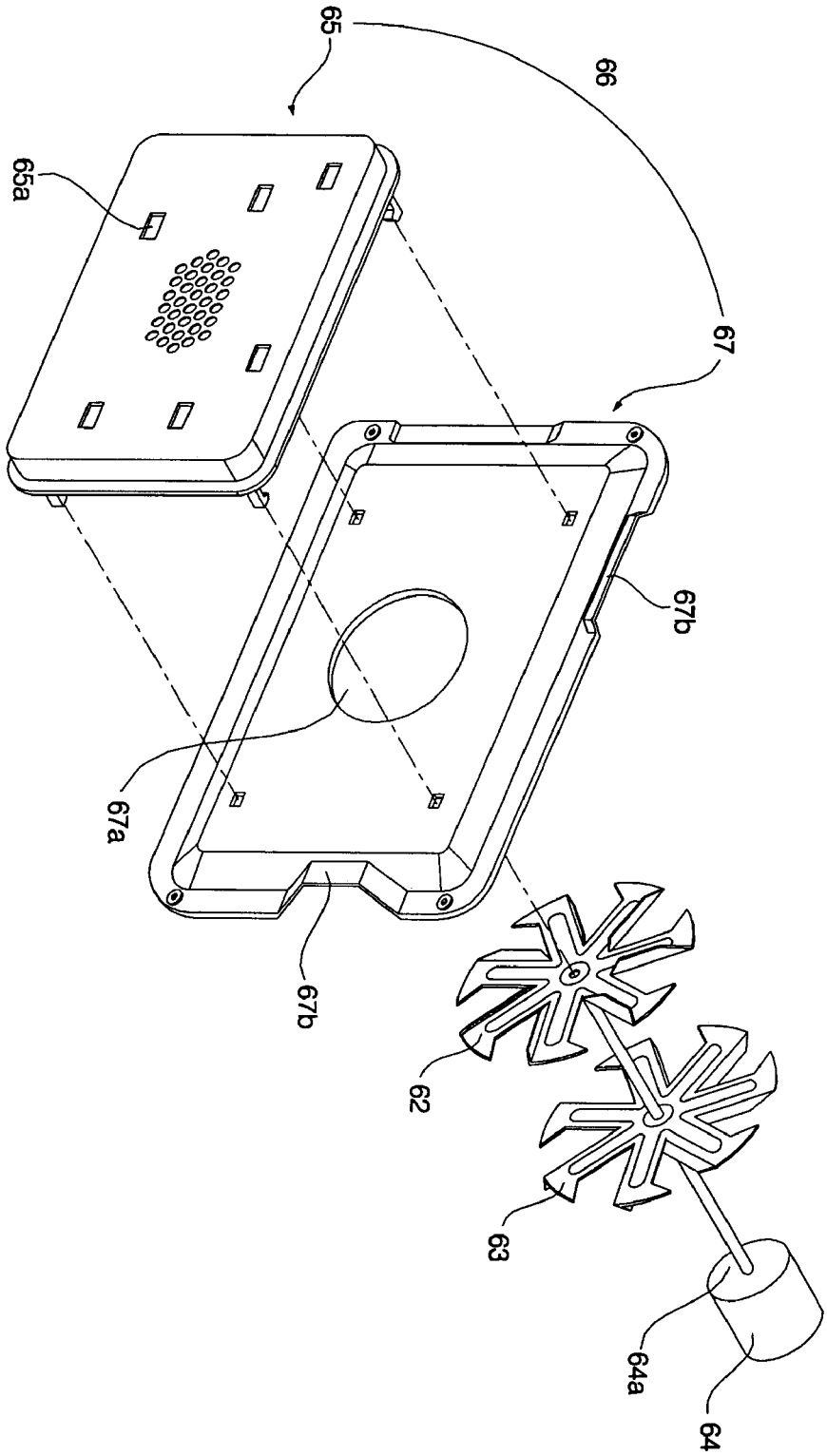
FIG. 6 is a disassembled perspective view of the convection chamber of the cooking device in accordance with the present invention.

FIG. 4 is a partially exploded perspective view of a cooking device in accordance with the present invention, FIG. 5 is a longitudinal sectional view of a convection chamber of the cooking device in accordance with the present invention, and FIG. 6 is a disassembled perspective view of the convection chamber of the cooking device in accordance with the present invention.

As shown in FIGS. 4 to 6, the cooking device in accordance with the present invention comprises a cabinet 50 defining the external appearance of the cooking device, a cooking chamber 52 provided in the cabinet 50 for heating food so that the food can be cooked, an electric component chamber 54 provided in the cabinet 50 such that the electric component chamber 54 is located above the cooking chamber 52, a door 56 installed on the front surface of the cabinet 50 for opening and closing the cooking chamber 52, and a convection chamber 60 for uniformly dispersing air in the cooking chamber 52.

An electric heater 52*a* for increasing the temperature of the cooking chamber 52 is installed on the internal upper, lower and rear surfaces of the cooking chamber 52.

A blower 55 for sucking external air into the electric component chamber 54 so that the electric component chamber 54 is cooled by the air and then discharging the air to the outside of the cabinet 50 is provided in the electric component chamber 54.

The lower end of the door 56 is hinged to the cabinet 50 so that the door 56 is rotated centering on the hinged lower end thereof to open and close the cooking chamber 52.

Now, the structure of the door 56 will be described in detail. The door 56 comprises a plurality of glass plate members 56*a*~56*d* spaced from each other by a designated interval so that the door 56 has a cooling channel communicated with the electric component chamber 54 and the air in the door 56 is cooled by the blowing force of the blower 55. Here, the glass plate members 56*a*~56*d* includes first to fourth glass plate members, which are disposed in order from the outer portion to the inner portion.

The cooling channel of the door 56 includes a suction channel 56*e* for allowing external cool air to be sucked to the electric component chamber 54 through the door 56, and a discharge channel 56*f* for allowing the air discharged from the electric component chamber 54 to be partially discharged to the outside through the door 56.

The suction channel 56*e* of the door 56 allows the air to be sucked from the suction channel 56*e* to the electric component chamber 54 through a space located between the upper surface of the door 56 and the cabinet 50. Preferably, A channel of the air sucked from the suction channel 56*e* of the door 56 to the electric component chamber 54 is located at the side of a channel of the air discharged from the electric component chamber 54 so that the air sucked to the electric component chamber 54 does not interfere with the air discharged from the electric component chamber 54.

The convection chamber 60 comprises a convection fan 62 rotatably installed in the cooking chamber 52, a convection motor 64 for rotating the convection fan 62, and a convection cover 66 provided in front of the convection fan 62 and having a channel for collecting air in the cooking chamber 52, sucking the air to the convection fan 62, and then discharging the air from the convection fan 62 to the cooking chamber 52.

The convection fan 62 is a centrifugal fan, which sucks air in the centripetal direction and discharges the air in the centrifugal direction.

The convection fan 62 is rotatably installed on the internal rear surface of the cooking chamber 52, and is rotatably connected integrally with a rotary shaft 64*a* of the convection motor 64. Preferably, in order to ensure a uniform temperature in the cooking chamber 52, the convection fan 62 is located at the central portion of the internal rear surface of the cooking chamber 52. Further, in order to allow the air discharged from the convection fan 62 to be heated directly by the electric heater 52*a*, the electric heater 52*a* installed on the internal rear surface of the cooking chamber 52 is located around the convection fan 62.

The convection motor 64 is located in the rear of the cooking chamber 52 in the cabinet 50 so that the convection motor 64 is connected to the convection fan 62 by the rotary shaft 64*a*.

A radiating fan 63 is rotatably connected integrally with the rotary shaft 64*a* of the convection motor 64. The radiating fan 63 sucks external air from the outside of the cabinet 50 to cool the convection motor 64, and then discharges the air to the outside of the cabinet 50.

The convection cover 66 comprises a first cover 65 provided with suction holes 65*a* for sucking the air in the cooking chamber 52, and a second cover 67 forming a space 66' with the first cover 65 and provided with a suction hole 67*a* for sucking the air to the center of the convection fan 62 and discharge holes 67*b* for discharging the air from the convection fan 62 to the cooking chamber 52.

The suction holes 65*a* of the first cover 65 are located at the edge portion thereof and the central portion thereof corresponding to the center of the convection fan 62 so that the air in the cooking chamber 52 is uniformly sucked to the space 66' between the first cover 65 and the second cover 67.

The suction hole 67*a* of the second cover 67 is located at the central portion thereof so that the air in the space 66' between the first cover 65 and the second cover 67 is sucked to the center of the convection fan 62. Preferably, the discharge holes 67*b* of the second cover 67 are located at the edge portion thereof, because the convection fan 62 blows air in the centrifugal direction.

The first and second covers 65 and 67 may be integrally formed, or be separated from each other so that the first and second covers 65 and 67 can be divisionally cleaned as described later. That is, the first cover 65 may be detachably attached to the second cover 67 using bolts or hooks.

Hereinafter, the function of the above cooking device in accordance with the present invention will be described.

When the cooking device of the present invention is operated, the electric heater 52*a* is driven, and the air in the cooking chamber 52 is heated by the electric heater 52*a*. Further, the convection fan 62 is rotated by the convection motor 64, and the air in the cooking chamber 52 is uniformly dispersed by the convection chamber 60.

Now, a process for dispersing the air in the cooking chamber 52 by the convection chamber 60 will be described in detail.

The air in the cooking chamber 52 is collected in the space 66' between the first cover 65 and the second cover 67 through the suction holes 65*a* of the first cover 65. The air collected in the space 66' between the first cover 65 and the second cover 67 is sucked to the center of the convection fan 62 through the suction hole 67*a* of the second cover 67. The air sucked to the center of the convection fan 62 is discharged from the convection fan 62 in the centrifugal direction, and the air discharged from the convection fan 62 passes through the electric heater 62*a* installed on the internal rear surface of the cooking chamber 52 and is sucked again to the cooking chamber 52 through the discharge holes 67*b*.

Since the suction holes 65*a* of the first cover 65 are formed throughout all regions of the first cover 65, the air in the cooking chamber 52 is uniformly sucked through all regions of the first cover 65, thereby being uniformly heated.

When the air in the cooking chamber 52 is heated to a high temperature as described above, food placed in the cooking chamber 52 is cooked or waste in the cooking chamber 52 is decomposed by the heat.

As apparent from the above description, the present invention provides a convection chamber of a cooking device, which comprises a convection fan rotatably installed in a cooking chamber, a convection motor for rotating the convection fan, and a convection cover provided in front of the convection fan and having a channel for collecting air in the cooking chamber, sucking the air to the convection fan, and discharging the air from the convection fan to the cooking chamber, thereby allowing the air in the cooking chamber to be uniformly sucked to the convection fan so that the air in the cooking chamber can be uniformly heated.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A convection chamber of a cooking device, comprising:

a convection fan rotatably installed in a cooking chamber;

a convection motor that rotates the convection fan;

a convection cover provided in front of the convection fan and having a channel that collects air in the cooking chamber, sucks the air to the convection fan, and discharges the air from the convection fan to the cooking chamber; and a radiating fan provided between the convection fan and the convection motor and rotated by the convection motor.

2. The convection chamber as set forth in claim 1, wherein an electric heater that increases the temperature of the air in the cooking chamber is located around the convection fan.

3. The convection chamber as set forth in claim 1, wherein the convection fan is a centrifugal fan which sucks air in the centripetal direction and discharges the air in the centrifugal direction.

4. A convection chamber of a cooking device, comprising:

a convection fan rotatably installed in a cooking chamber;

a convection motor that rotates the convection fan; and a convection cover provided in front of the convection fan and having a channel that collects air in the cooking chamber, sucks the air to the convection fan, and discharges the air from the convection fan to the cooking chamber, wherein the convection cover comprises a first cover provided with suction holes that sucks the air in the cooking chamber, and a second cover forming a space with the first cover, and provided with a suction hole that sucks the air to the center of the convection fan and discharge holes that discharges the air from the convection fan to the cooking chamber.

5. The convection chamber as set forth in claim 4, wherein an electric heater that increases the temperature of the air in the cooking chamber is located around the convection fan.

6. The convection chamber as set forth in claim 4, wherein the convection fan is a centrifugal fan which sucks air in the centripetal direction and discharges the air in the centrifugal direction.

7. The convection chamber as set forth in claim 6, wherein an electric heater that increases the temperature of the air in the cooking chamber is located around the convection fan.

8. The convection chamber as set forth in claim 4, wherein:

a plurality of the suction holes are formed through the first cover; and the suction hole is located at the central portion of the second cover, and the discharge holes are located at the edge portion of the second cover.

9. The convection chamber as set forth in claim 8, wherein some of the suction holes are located at the central portion of the first cover.

10. The convection chamber as set forth in claim 4, wherein the first and second covers are integrally formed.

11. The convection chamber as set forth in claim 8, wherein the first cover is detachably attached to the second cover.

12. The convection chamber as set forth in claim 8, further comprising a radiating fan located between the convection fan and the convection motor and rotated by the convection motor.

13. A convection chamber of a cooking device, comprising:

a convection fan rotatably installed in a cooking chamber that sucks air in the centripetal direction and discharges the air in the centrifugal direction;

a convection motor that rotates the convection fan; and a convection cover provided in front of the convection fan and having a channel that collects air in the cooking chamber, sucks the air to the convection fan, and discharges the air from the convection fan to the cooking chamber, wherein the convection cover comprises a first cover provided with a plurality of suction holes that sucks the air in the cooking chamber, and a second cover forming a space with the first cover and provided with a suction hole located at the central portion thereof to suck the air to the center of the convection fan and discharge holes located at the edge portion thereof to discharge the air from the convection fan to the cooking chamber.

14. The convection chamber as set forth in claim 13, wherein an electric heater that increases the temperature of the air in the cooking chamber is located around the convection fan.

15. The convection chamber as set forth in claim 13, wherein some of the suction holes are located at the central portion of the first cover.

16. The convection chamber as set forth in claim 15, wherein an electric heater that increases the temperature of the air in the cooking chamber is located around the convection fan.

17. The convection chamber as set forth in claim 13, wherein the first and second covers are integrally formed.

18. The convection chamber as set forth in claim 13, wherein the first cover is detachably attached to the second cover.

19. The convection chamber as set forth in claim 13, further comprising a radiating fan located between the convection fan and the convection motor and rotated by the convection motor.

* * * * *